US005975488A

United States Patent [19]

Imhof et al.

[11] Patent Number: 5,975,488

[45] Date of Patent: Nov. 2, 1999

[54] LIFTING MAGNET ARRANGEMENT

[75] Inventors: Rainer Imhof, Frammersbach; Torsten Witte, Lohr, both of Germany

[73] Assignee: Mannesmann Rexroth AG, Lohr, Germany

[21] Appl. No.: 09/068,454

[22] PCT Filed: Oct. 25, 1996

[86] PCT No.: PCT/EP96/04667

§ 371 Date: Jun. 4, 1998

§ 102(e) Date: Jun. 4, 1998

[87] PCT Pub. No.: WO97/18568

PCT Pub. Date: May 22, 1997

[30] Foreign Application Priority Data

Nov. 15, 1995 [DE] Germany ..... 195 42 642
Oct. 7, 1996 [WO] WIPO ..... PCT/EP96/04343

[51] Int. Cl.[6] ..... H01F 7/16

[52] U.S. Cl. ..... 251/129.18; 251/129.1; 335/266

[58] Field of Search ..... 251/129.18, 129.1, 251/129.16; 335/266, 261

[56] References Cited

U.S. PATENT DOCUMENTS 4,484,167 11/1984 Gibas ..... 335/260
4,658,321 4/1987 Schwenzer et al. ..... 335/261
5,692,463 12/1997 Liang et al. ..... 251/129.01
5,785,298 7/1998 Kumar ..... 251/129.16
5,785,299 7/1998 Katsuta et al. ..... 251/129.18
5,890,662 4/1999 Dykstra ..... 251/129.18 X

FOREIGN PATENT DOCUMENTS 1539938 1/1970 Germany .

OTHER PUBLICATIONS

Reference N is cited in PCT application.

*Primary Examiner*—Denise L. Ferensic
*Assistant Examiner*—Meredith H. Schoenfeld
*Attorney, Agent, or Firm*—Oblon, Spivak, McClelland, Maier & Neustadt, P.C.

[57] ABSTRACT

A lifting magnet arrangement. The arrangement has a thrust direction in which a pressure spring which biases the armature into its basic position may be set. This is done by an actuating section designed to project from the magnet housing. By using this configuration it is not necessary to open the magnet housing for adjustment so that the adjusting process may be carried out with an oil-floated armature.

20 Claims, 3 Drawing Sheets

LIFTING MAGNET ARRANGEMENT

BACKGROUND OF THE INVENTION

1. Field of the Invention

The invention concerns a lifting magnet arrangement for controlling a pressure regulating valve or directional control valve.

2. Discussion of the Background

Lifting magnet arrangements are utilised for controlling hydraulic components, such as, e.g., switching valves or proportional valves, directional control valves or pressure regulating valves and sliding valves or seat valves. Fundamentally it is possible to classify them into structures including DC magnets and those including AC magnets, wherein armature switching is carried out in air ("dry" magnet) or in oil ("wet" magnet), respectively. I.e., the armature cavity is in the latter case filled with oil and relieved toward the tank. In proportional valves, so-called proportional magnets are used which belong to the group of DC lifting magnets and generate an output (force or stroke) which is proportional with the electrical input signal. Depending on a specific application purpose, classification is made into stroke-controlled magnets or force-controlled magnets, with the magnetic force being controlled in the latter by modification of flow while the stroke change may be disregarded, whereas in the former the armature position (stroke) is controlled.

FIG. 1 shows a view of a conventional lifting magnet arrangement including a thrusting actuating element, wherein a DC magnet switching in oil is employed.

A like lifting magnet arrangement 1 basically consists of a magnet housing 2 into which a pole tube 4 including a wound coil 10 is press-fitted. The pole tube one the one hand serves to limit the coil space, and as an axial termination of the housing on the other hand. This function is served on the other front side by a cover plate 8 which, in a given case (e.g. for intervention within the magnet force system), may also be divided into ring 9 and lid 8.

The magnet coil 10 may be connected to a current/voltage supply via a terminal 12 located on the housing 2.

The pole tube 4 includes an axial bore wherein an armature 16 is guided such as to be axially displaceable.

On its left-hand front side in the representation of FIG. 1, the armature 16 carries a tappet 18 which projects from the pole tube 4 in the axial direction and, in the shown embodiment, may be covered by a protective cap 20 (indicated by phantom lines in FIG. 1) for transporting purposes. The axial bore 14 is radially stepped back in the area of the tappet 18 in such a way as to form, depending on the construction, a guiding portion or at least a receiving space for the tappet 18.

On the other end portion of the armature 16 which is removed from the tappet 18, a coaxially extending rod 22 is fastened which projects into the cavity of the cover cap 8.

The front-side end portion of the pole tube 4 is formed by a stop member 24 which is screwed into the pole tube 4 and forms an axial stop for the armature 16. The rod 22 extends through the stop member 24 in a central position and comprises at its end portion 22 a threaded portion onto which a spring plate 26 is screwed as an armature-side abutment. A pressure spring 28 acts on this latter one, with the other end portion of the pressure spring 28 being supported on the adjacent front surface of the stop member 24 forming a housing-side abutment. The spring plate 26 (armature-side abutment) thus is arranged at a greater axial distance from the armature space than the axial stop (housing-side abutment).

By axial adjustment of the spring plate 26 along the thread at the end portion of the rod 22, it is possible to adjust the bias of the pressure spring 28 and thus the force biasing the armature toward the stop member 24.

Upon excitation of the lifting magnet, a force acts on the armature 16 to displace it against the bias of the spring toward the left (thrust direction) in the representation of FIG. 1 (stroke-controlled magnet) or builds up a magnetic force counteracting the pressure spring force without resulting in a substantial stroke (force-controlled magnet).

The axial bore 14, i.e., the armature space formed by it, the space encompassed by the protective cap 20, and the space enclosed by the cover plate 8 in prolongation of the pole tube 4 in which the pressure spring 28 is arranged (spring space), are filled with oil, with this oil space being connected to a tank port (not shown) via a conduit that is also not shown here, so that inside the lifting magnet a constant oil pressure (tank pressure) permanently prevails.

For the purpose of balancing and adjusting the force of the lifting magnet, or more precisely of the tappet 18 acting on the slide of the valve to be controlled (switching/proportional valve), the spring bias must be set in accordance with the force/stroke characteristic line of the magnet. For this setting process the cover cap 8 must be removed in the known valve arrangement, so that the oil contained in this space flows out of the lifting magnet arrangement 1. I.e., the pressure prevailing in the lifting magnet is not the predetermined operating pressure (tank pressure) but the environmental pressure (atmospheric pressure), so that the adjustment performed at atmospheric pressure may eventually be faulty at operating pressure, i.e., when the lifting magnet arrangement is filled with oil, and thus result in inaccuracies of valve control.

In contrast thereto, the invention is based on the object of furnishing a lifting magnet arrangement wherein simple adjustment at minimum expense in terms of device technology is possible without having to interfere with the hydraulic system.

This object is attained by the features of claim 1.

Due to the measure of making the adjusting means, which serves for changing the pressure spring bias by displacing the housing-side abutment, project from the housing of the lifting magnet arrangement in an oil-tight manner, basic adjustment may also be performed for a thrusting magnet without the housing of the lifting magnet having to be opened. I.e., during basic adjustment those pressure conditions which will also prevail during use of the arrangement are present on inside the lifting magnet. The force adjustment may thus be carried out with small expense in terms of device technology at substantially higher precision. In addition, due to permanent accessibility of the adjusting means, or more precisely of the actuating section of the adjusting means, it is even possible to quickly perform subsequent fine adjustment without having to disassemble the lifting magnet arrangement, so that the adjusting process may be carried out more easily, with more precision, more quickly in contrast with previous solutions, and free of oil. The latter circumstance results in cleaner assembly and reduced strain on the environment.

A particularly simple solution is obtained if the pressure spring is supported on an axial stop, the axial position of which may be changed by means of the actuating section which is accessible from the outside.

A particularly simple structure is obtained with the development in accordance with claim 3, according to which the actuating section has the form of a cap screwed into an inner bore of a bush-type stop member which constitutes a front-side termination of the lifting magnet housing.

The structural length of the lifting magnet arrangement in the axial direction may be reduced if the pressure spring is encompassed by the cap in portions thereof.

In the case where the axial stop and the cap are formed separate from each other, the axial stop can be biased against the cap by means of a spring member, so that axial separation of axial stop and cap can be prevented thanks to the action of the pressure spring. A particularly high pressing force on minimum space is obtained if a spring plate assembly is employed for biasing the axial stop.

As an alternative, it is also possible to form the axial stop integrally with the cap.

In an alternative embodiment, the axial stop may be connected to the mounting cap, with this connection preferably being effected by pressing.

An easy option for mounting an emergency actuation consists of an emergency actuation pin which is accessible from the outside and guided in the actuating section or in the adjustment cap such as to be axially slidable, whereby axial displacement of the armature may be brought about manually in the cause of a power failure.

Easy basic adjustment is possible if the basic position of the spring plate is adjustable on the spring rod.

As was already mentioned above, the lifting magnet arrangement according to the invention may be used for both stroke-controlled and force-controlled lifting magnets and is fundamentally suited for controlling switching valves and proportional valves.

Further advantageous developments of the invention are the subject matters of the remaining appended claims.

BRIEF DESCRIPTION OF THE DRAWINGS

In the following, preferred exemplary embodiments of the invention shall be explained in more detail by making reference to schematic drawings, wherein.

In the figures, identical reference symbols shall be used for analogous components for the sake of simplicity.

DESCRIPTION OF THE PREFERRED EMBODIMENT

Figure 1:
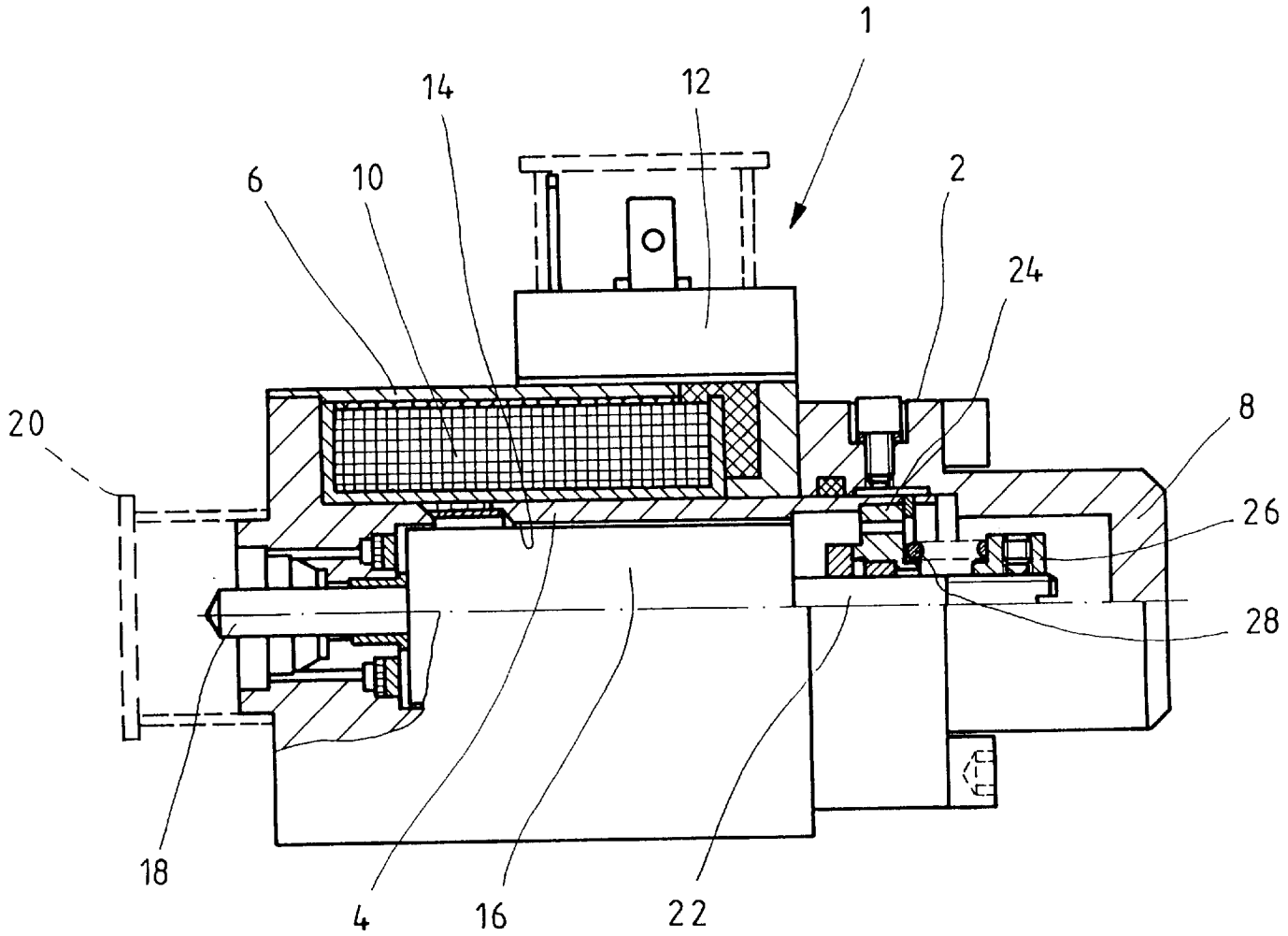
FIG. 1 shows a longitudinal sectional view of part of a conventional lifting magnet arrangement.
Figure 2:
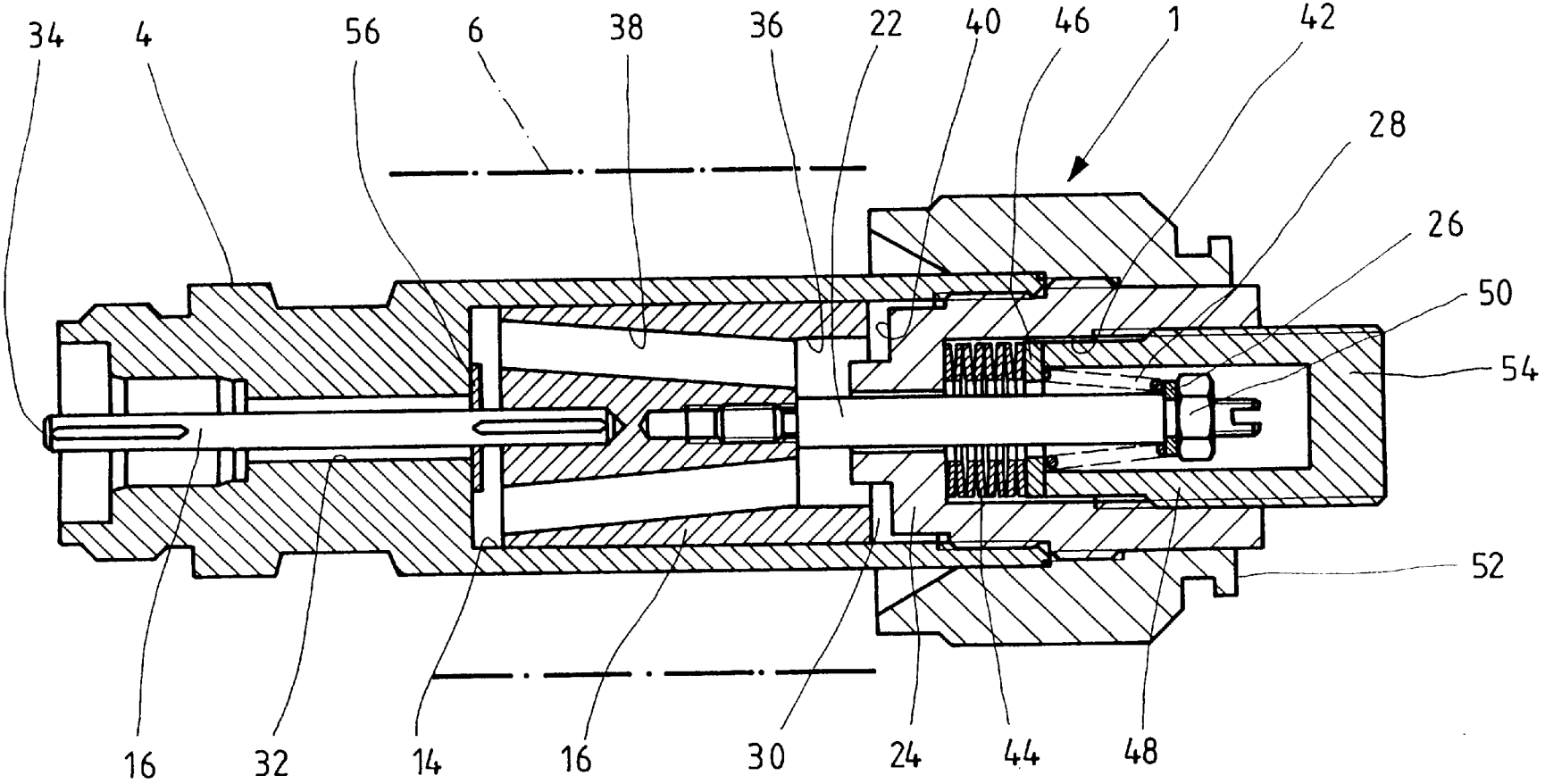
FIG. 2 shows a first embodiment of a lifting magnet arrangement according to the invention, wherein a coil shell was omitted.

In the representation in accordance with FIG. 2, the coil shell 6 which is indicated by a dash-dotted line and which may be placed over the arrangement represented in FIG. 2 was omitted.

The lifting magnet arrangement 1 in turn comprises a pole tube 4 which includes an axial bore 14, the right-hand portion of which in the representation of FIG. 2 expands radially and forms an armature space 30. Inside the armature space 30 there is guided, such as to be axially slidable, an armature 16 having fastened at its left-hand end portion a tappet 18 which extends through a radially reduced section 32 of the axial bore 14. The freely protruding end of the tappet 16 is provided with a contact surface 34 having the shape of a sphere or truncated cone, whereby the tappet 18 may be brought into contact with an actuating element of the valve (not shown) to be controlled.

In the armature 16, two through bores 38 extending obliquely with respect to the axis of the lifting magnet arrangement 1 are formed, whereby the compartments separated from the armature space 30 by the armature 16 communicate with each other. Upon a stroke displacement of the armature 16, a compensating flow may take place via the through bores 38, so that the oil may change over from the diminishing compartment into the other compartment.

In the right-hand front side of the armature 16 in the representation of FIG. 2 a hollow 36 is formed, into the front side of which a rod 22 is screwed. The right-hand end portion of the pole tube 4 is terminated by a stop member 24 which is fixedly inserted into the end portion of the pole tube 4. (In the exemplary embodiment, the stop member 24 is screwed into the pole tube 4 via a threaded portion).

On the front surface of the stop member 24 facing the armature 16, a stop surface 40 for the adjacent front surface of the armature 16 is formed, so that the axial movement of the armature 16 toward the right side in the representation of FIG. 2 is restricted when approaching the stop surface 40.

The stop surface 40 is followed by a hub-shaped portion through which the rod 22 extends, so as to project into the inside of the stop member 24 having a bush-type construction.

The stop member 24 comprises a receiving bore 42 which widens in continuation of the hub-shaped portion and on the front surface of which a disk spring assembly 44 is supported. Coaxially with the disk spring assembly 44 an axial stop ring 46 is received in the receiving bore 42. The end of the stop member 24, which is open in the representation of FIG. 2, is closed by an adjustment cap 48 which is in threaded engagement with the receiving bore 42 of the connecting piece 24, so that the end portion of the rod 22 extending through the disk spring assembly 44 and the stop ring 46 is encompassed by the adjustment cap 48. By turning the adjustment cap 48 into the thread of the stop member 24, the axial stop ring 46 may be axially shifted against the bias of the disk spring assembly 44, i.e., the axial stop ring 46 is pressed against the adjustment cap 48 by the disk spring assembly 44.

The radial width of the axial stop ring 46 herein is formed to be greater than the adjacent wall thickness of the adjustment cap 48, so that the axial stop ring 46 radially projects inwardly toward the spring rod 22. On this radially projecting portion of the axial stop ring 46 an end portion of a pressure spring 28 is supported. The other end portion contacts a spring plate 26 which is fixed on a radially stepped-back end portion of the spring rod by means of a retaining nut 50. In the shown embodiment, the spring rod 22 at the end portion thereof furthermore includes a slot whereby the spring rod 22 can be turned into the armature 16.

In the shown embodiment the pressure spring 28 has a conical shape so that the contact surface at the spring plate 26 has a smaller diameter than the one at the axial stop ring 46. The same function may, however, also be realised by means of a cylindrical pressure spring.

The armature space 30 and the spring space defined by the stop member 24 and by the adjustment cap 48 are in the assembled state of the lifting magnet arrangement 1 filled with hydraulic fluid, with the named spaces being connected to a tank via the axial bore 32 of the pole tube.

Axial fixation of the coil shell 6 (indicated in phantom lines) is achieved by means of a spigot 52 which is in threaded engagement with the outer circumference of the connecting piece 24 and encompasses the adjacent end portion of the pole tube 4 with a jacket portion and presses the coil shell 6 against a valve housing (not represented).

As can furthermore be seen from FIG. 2, the end portion of the adjustment cap 48 which is removed from the disk spring assembly 44 axially projects from the connecting piece 24, so that this part forms an actuating section 54 which is accessible from the outside for possible adjustment, either manually or by means of a simple tool, by an operator.

As a safety against unauthorised actuation of the adjusting means it is possible to conceal the actuating section 54 with an additional protective cap (not shown) which may be fastened to the spigot 52.

Moreover on the left-hand front side of the armature space 30 in the representation of FIG. 2, in the range of the guiding section 32, a disk 56 serving as an axial stop for the armature 16 is provided, whereby the axial movement thereof to the left side in the representation of FIG. 2 is determined.

In basic adjustment of the lifting magnet arrangement, biasing of the pressure spring 28 may be achieved by axially displacing the axial stop ring 46. Herein the axial stop ring 46 is pressed against the disk spring assembly 44 by means of the adjustment cap 48, with the spring rate and bias thereof being selected such that, in the case of a deformation of the pressure spring 28, a substantial axial displacement of the axial stop rings 46 due to compression of the disk spring cannot occur.

Another preliminary adjustment can be enabled due to the circumstance that the spring plate 26 is additionally adjustable by means of washers and by corresponding adjustment of the retaining nut 50 the axial position of the spring plate 26 may additionally be adjusted.

Although the above described embodiment concerns a proportional magnet arrangement with force adjustment, it is basically also possible to use stroke-controlled magnet arrangements.

Another variation of the lifting magnet arrangement according to the invention consists in the axial stop ring 46 being integrally formed with the adjustment cap 48, in which case the disk spring assembly might be omitted. In this variation it would have to be possible to open the adjustment cap 48 in some form or other such as to enable mounting of the pressure spring 28 and of the spring plate 26.

In addition, the adjustment cap 48 may include additional functions, e.g. for manual actuation (so-called "emergency hands").

Figure 3:
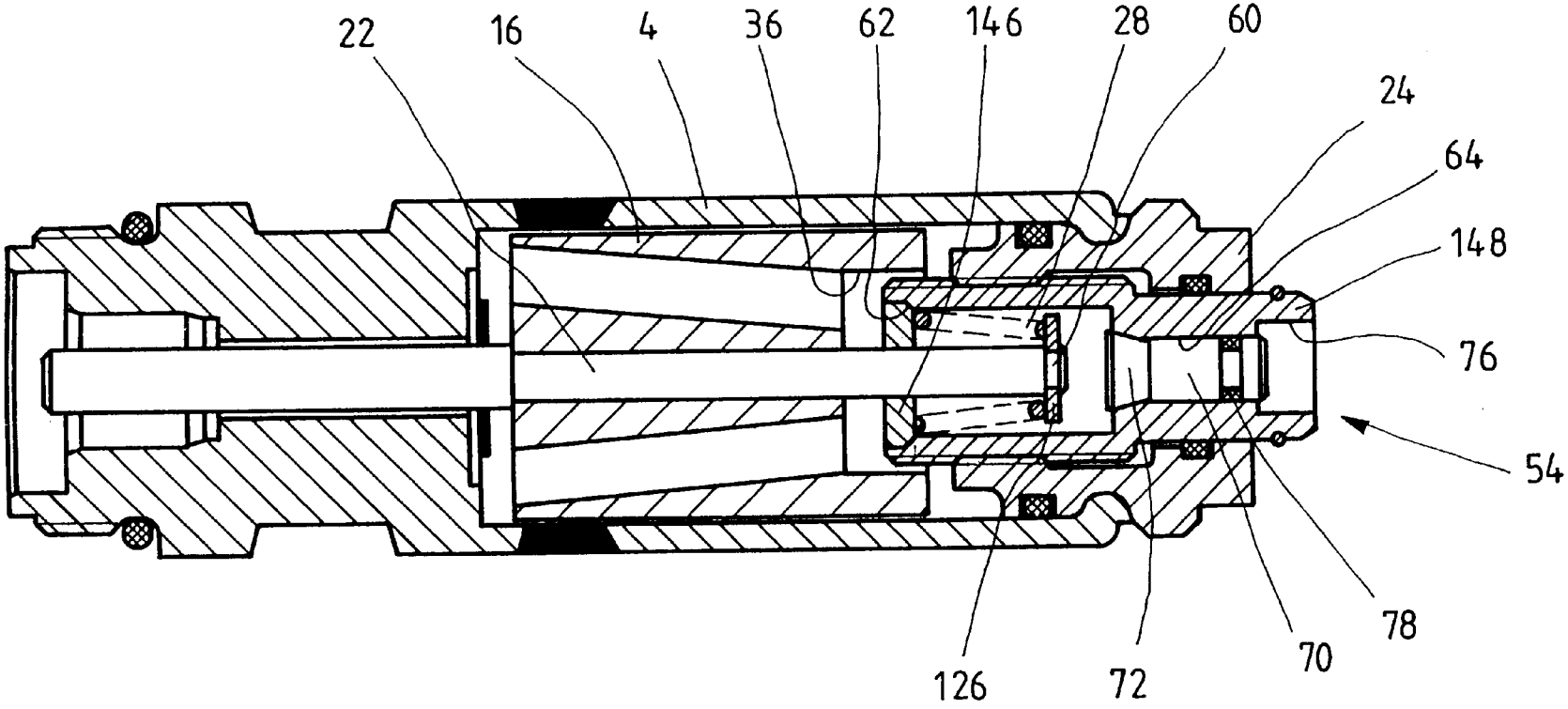
FIG. 3 shows another embodiment of a lifting magnet arrangement according to the invention.

In FIG. 3 another variation of an actuating section 54 for adjusting the spring bias is shown.

For the sake of simplicity, in FIG. 3 only the right-hand end portion of the lifting magnet arrangement in the representation of FIG. 2 is shown.

Like in the above described exemplary embodiments, the armature 16 is guided in an axially slidable manner in the pole tube 4 and is provided with a spring rod 22 on which the pressure spring 28 acts.

In the embodiment. shown in FIG. 3, the spring plate 126 is guided not on the spring rod 22 in an axially slidable manner like the spring plate 26 in the embodiment according to FIG. 2, but is positively received in an annular groove 60 of the spring rod 22, so that the armature-side abutment is not adjustable.

Another difference from the above described embodiment resides in the fact that into the armature-side end portion of the adjustment screw 148 located on the left side in the representation of FIG. 3, an axial stop ring 146 is press-fitted which thus forms the housing-side abutment for the pressure spring 28. To this end, the inner bore of the adjustment screw 148 is provided with an annular shoulder 62 on which the stop ring 146 may be supported. Fixation of the stop ring 146 can, of course, also be achieved by adhesive, soldering etc.

As it is not required any more in this embodiment to provide receiving space for the disk spring assembly or other spring members (position 44 in FIG. 2) in the stop member 24, the axial length of the stop member 24 may be reduced considerably in comparison with the embodiment represented in FIG. 2, so that the armature-side end portion of the adjustment cap 48 axially projects beyond the stop member 24 and plunges into the hollow 36 of the armature 16. The total length of the lifting magnet arrangement may thus be reduced by this development in comparison with the solution represented in FIG. 2.

In order to enable emergency actuation of the armature 16, e.g. in the case of power failure, a guide bore 64 is formed in the end portion of the adjustment cap 148 which is accessible from the outside, wherein an emergency actuation pin 70 is guided in an axially displaceable manner. This emergency actuation pin 70 is held in a position by the bias of the seal ring 78. Prior to first-time actuation it takes a basic position in which it contacts a matchingly shaped portion of the guide bore 64 with a stop 72. This emergency actuation pin 70 may be displaced from the outside—i.e., from the right side in the representation of FIG. 3—by means of a suitable tool until it gets into contact with the spring rod 22 of the armature 16 to take the latter into its switching position.

In the embodiment represented in FIG. 3, adjustment of the adjustment cap 148 is realised by means of a hexagonal recess 76 arranged approximately in prolongation of the guide bore 64.

In the embodiment represented in FIG. 3, fixation of the pole tube 4 to the stop member 24 is realised by flanging the end portion of the pole tube 4 in such a way that it plunges into a corresponding annular receiving groove of the stop member 24, whereby positive connection is obtained.

For the rest, the embodiment represented in FIG. 3 essentially corresponds to the one shown in FIG. 2, so that a further description thereof may be omitted.

Owing to the design of the pressure spring adjustment according to the invention, the basic adjustment of the lifting magnet arrangement may be realised without opening the magnet housing, so that an adjustment may be carried out in the presence of a filling of oil in the housing, whereby faulty adjustment is prevented.

What is disclosed is a lifting magnet arrangement with thrust direction 1 in which an adjustment of a pressure spring 28 biasing the armature 16 into its basic position may be carried out via an actuating section 54 which is designed such as to project from the magnet housing. Owing to this configuration it is not necessary to open the magnet housing for adjustment, so that the adjusting process may be carried out with an oil-floated armature.

We claim:

1. A lifting magnet arrangement for controlling a valve, in particular a pressure or directional control valve including a coil shell and a displaceable armature which is slidably guided in an armature space of a housing and which is biased through a pressure spring into a basic position from which it may be displaced by controlling the coil shell wherein the pressure spring is supported at a housing-side abutment and at an armature-side abutment which has a greater axial distance from the armature space than the housing-side abutment and adjusting means for adjusting the pressure spring bias, characterised in that the adjusting means include an actuating section which is designed such as to project from the housing in a substantially oil-tight manner, and whereby the housing-side abutment may be adjusted.

2. The lifting magnet arrangement in accordance with claim 1, characterised in that the armature at one end portion comprises a rod having formed thereon an armature-side abutment at which an end of the adjusting spring or pressure spring acts, with the other end being supported at an axial stop which represents a housing-side abutment and is adjustable through the actuating section.

3. The lifting magnet arrangement in accordance with claim 2, characterised in that the rod plunges into a bush-type stop member for the armature which forms a front side of the housing, and in the inner bore of which the axial stop of the pressure spring is guided, and that the actuating section is an adjustment cap which is screwed into the inner bore and the annular front surface of which contacts the axial stop.

4. The lifting magnet arrangement in accordance with claim 2, characterised in that the armature-side abutment is encompassed by the adjustment cap.

5. The lifting magnet arrangement in accordance with claim 2, characterised in that the axial stop is biased against the actuating section by means of a spring member.

6. The lifting magnet arrangement in accordance with claim 3, characterised in that the spring member is a disk spring assembly which is supported on a radial shoulder of the stop member.

7. The lifting magnet arrangement in accordance with claim 3, characterised in that the axial stop is formed integrally with the adjustment cap.

8. The lifting magnet arrangement in accordance with claim 3, characterised in that the axial stop is fastened to the adjustment cap.

9. The lifting magnet arrangement in accordance with of claim 2, characterised in that the armature-side abutment is adjustable relative to the spring rod.

10. The lifting magnet arrangement in accordance with claim 3, characterised in that an emergency actuation pin is guided in an axially slidable manner in the one end portion of the adjustment cap which is removed from the armature.

11. The lifting magnet arrangement in accordance with claim 1, characterised in that the lifting magnet is a switching magnet or a proportional magnet and is controlled in terms of stroke or force.

12. The lifting magnet arrangement in accordance with claim 3 characterized in that the armature-side abutment is encompassed by the adjustment cap.

13. The lifting magnet arrangement in accordance with claim 3, characterized in that the axial stop is biased against the actuating section by means of a spring member.

14. The lifting magnet arrangement in accordance with claim 4, characterized in that the axial stop is biased against the actuating section by means of a spring member.

15. The lifting magnet arrangement in accordance with claim 5, characterized in that the spring member is a disk spring assembly which is supported on a radial shoulder of the stop member.

16. The lifting magnet arrangement in accordance with claim 4, characterized in that the axial stop is formed integrally with the adjustment cap.

17. The lifting magnet arrangement in accordance with claim 4, characterized in that the axial stop is fastened to the adjustment cap.

18. The lifting magnet arrangement in accordance with claim 3, characterized in that the armature-side abutment is adjustable relative to the spring rod.

19. The lifting magnet arrangement in accordance with claim 4, characterised in that the armature-side abutment is adjustable relative to the spring rod.

20. The lifting magnet arrangement in accordance with claim 5, characterised in that the armature-side abutment is adjustable relative to the spring rod.

* * * * *